US008131003B2

(12) United States Patent
Park et al.

(10) Patent No.: US 8,131,003 B2
(45) Date of Patent: Mar. 6, 2012

(54) SPRING REVERBERATOR AND ASSEMBLING METHOD THEREOF

(76) Inventors: Jong Hwan Park, Seoul (KR); Hyun Park, Seoul (KR)

( * ) Notice: Subject to any disclaimer, the term of this patent is extended or adjusted under 35 U.S.C. 154(b) by 1049 days.

(21) Appl. No.: 12/072,043

(22) Filed: Feb. 22, 2008

(65) Prior Publication Data

US 2009/0016560 A1 Jan. 15, 2009

(30) Foreign Application Priority Data

Jul. 9, 2007 (KR) ..... 20-2007-0011280 U
Dec. 21, 2007 (KR) ..... 10-2007-0135311

(51) Int. Cl.
*H04R 1/00* (2006.01)

(52) U.S. Cl. ..... 381/400; 381/163; 381/174

(58) Field of Classification Search ..... 381/163, 381/174, 400
See application file for complete search history.

(56) References Cited

U.S. PATENT DOCUMENTS 4,112,396 A * 9/1978 Honda ..... 333/145
5,113,742 A * 5/1992 Matsumoto ..... 84/615
5,657,300 A * 8/1997 Takahashi ..... 369/13.17
2005/0081703 A1* 4/2005 Hoover ..... 84/726
2005/0120870 A1* 6/2005 Ludwig ..... 84/661

* cited by examiner

*Primary Examiner* — Phuc Dang
(74) *Attorney, Agent, or Firm* — Blakely, Sokoloff, Taylor & Zafman

(57) ABSTRACT

The present invention discloses a spring reverberator and an assembling method thereof, in which the spring reverberator comprises: a casing, a driving transducer received in the casing, a pickup transducer received in the casing, and coil springs vibratingly coupled to the driving and pickup transducers. The driving and pickup transducers respectively include a vibration unit and a magnetic core. The vibration unit comprises a support plate including at least one cut-out groove, through which a wire is soldered directly to the support plate. The vibration unit and the magnetic core are prepared in a modular type to be inserted in a sliding manner and fixed in the casing.

9 Claims, 4 Drawing Sheets

SPRING REVERBERATOR AND ASSEMBLING METHOD THEREOF

CROSS-REFERENCES TO RELATED APPLICATIONS

The present invention claims priority of Korean Utility Model application No. 20-2007-11280, filed on Jul. 9, 2007 and Korean patent application number 10-2007-135311, filed on Dec. 21, 2007, which are incorporated by references in its entirety.

BACKGROUND OF THE INVENTION

The present invention relates to a spring reverberator and an assembling method thereof; and, more particularly, a spring reverberator with components having a simple structure for improving the assembly productivity and an assembling method thereof.

In general, a variety of effectors are used in electric musical instruments or in a mixer for an audio in order to obtain dynamic, vivid sound effects. Among them, an apparatus for adding an echo to sound is called a reverberator. Although there are various kinds of reverberators, a spring reverberator is known to provide reverb effects in a relatively simple and inexpensive way.

FIG. 1 is a conceptual diagram of a spring reverberator according to the conventional art.

As shown in FIG. 1, a conventional spring reverberator 100 includes a driving transducer 10, a pickup transducer 20 and a coil spring 32 spanned between the transducers 10 and 20. In this conventional spring reverberator, the driving transducer 10 converts an audio signal inputted from a sound source into a mechanical vibration and transfers it to the coil spring 32, and the pickup transducer 20 converts the mechanical vibration transferred by the coil spring 32 into an audio signal added with a reverb effect produced from the coil spring 32 and outputs the signal.

FIG. 2 is a perspective view of the driving transducer 10 of the conventional spring reverberator shown in FIG. 1.

Referring to FIG. 2, the driving transducer 10 comprises a support frame 50 to which a magnetic core 70 is fixed. In order to serve as a magnetic circuit, the magnetic core 70 has a coil 72 at a middle leg 74. The support frame 50 comprises tubular portions 52 that are stretched out in the opposite direction to coil springs 32*a*, 32*b*, respectively. One end of a wire 65 extends into the tubular portion 52, and is soldered on a washer 66 that is pressed and held securely against a stop ledge (not shown) in the tubular portion 52. The other end of the wire 65 is formed into the shape of a hook 65*a* to be able to connect to the coil spring 32*a*. Near the hook 65*a*, an annular permanent magnet 62 is adhesively secured to the wire 65. To be more specific, the permanent magnet 62 is positioned in a magnetic gap between legs 72 and 74 of the magnetic core 70 (or in a magnetic gap between legs 74 and 76). In addition, a rubber damper ring 64 for absorbing the rotational vibration of the wire 65 is tightly fitted onto the wire 65 to be anchored at a predetermined position inside the tubular portion 52.

Referring again to FIG. 2, an assembling method of the driving transducer 10 in the conventional spring reverberator will now be described.

First, the annular permanent magnet 62 is slid over the wire 65 and adhesively fixed thereto near the hook 65*a*. Next, the damper ring 64 is tightly fitted to the wire 65 and pushed in the tubular portion 52 of the support frame 50, so that it can be anchored at a desired position in the tubular portion 52. Meanwhile, the magnet 62 on the wire 65 is positioned in a magnetic gap between the legs 72 and 74 (or in a magnetic gap between legs 74 and 76) of the magnetic core 70, with the magnet 62 being exposed out of the tubular portion 52. The other end of the wire 65 opposite to the hook 65*a* passes through the tubular portion 52 till it stretches outside of the tubular portion 52. The washer 66 is fitted onto the stretched-out portion of the wire 65 and then pushed into the tubular portion 52 until stopped by the stop ledge (not shown) in the tubular portion 52. Subsequently, the washer 66 and the wire 65 are soldered so that the other end of the magnet 62 is fixed to the support frame 50 via the wire 65. Further, the magnetic core 70, on which a coil-wound bobbin 76 is mounted, is fastened to the support frame 50 by a screw and the like. As mentioned earlier, the magnetic core 70 is arranged and fixed to the support frame 50 in order for the magnet 62 to be positioned in the magnetic gap between the legs 72 and 74 (or in the magnetic gap between the legs 74 and 76) of the magnetic core 70.

In the conventional spring reverberator, the driving transducer 10 and the pickup transducer 20 have substantially identical structures, so the pickup transducer 10 is assembled similarly to the driving transducer 10. More details are found in U.S. Pat. No. 5,539,830, which was granted to the present inventor.

As mentioned above, the conventional spring reverberator has disadvantages that a number of components should be assembled together in a given order, and the washer 66 and the wire 65 have to be soldered while the washer 66 is in tight contact with the stop ledge in the tubular portion 52, thereby requiring highly skilled manual dexterity and requiring a long time to assemble the components. Also, for accurate vibration of the permanent magnet 62, the axis of the permanent magnet 62 should be kept horizontal between the legs 72 and 74, or 74 and 76 of the magnetic core 70. However, in the conventional assembly process described above, the damper ring 64 and the washer 66 fitted tightly onto the wire 65 have to be pushed into the tubular portion 52 with the magnet 62 being fixed adhesively onto the wire 65 near the hook 65. Therefore, twisting stress is applied to the wire 65 during the pushing process, thereby twisting the axial direction of the magnet 62. Further, since the wire 65 is very thin (less than about 1 mm in diameter), it may be broken when the magnet 62 is turned to the opposite direction to adjust the twisted axial direction.

To resolve these disadvantages, the present inventor devised a support frame having a U-shaped boss (please refer to U.S. Pat. No. 5,539,830). According to this modified support frame structure, since the top of the tubular portion is open, the wire and a washer may be soldered easily, which resultantly reduces the assembly time compared with the support frame shown in FIG. 2. However, this modified support frame also does not solve the foregoing disadvantages, such as, the assembly has to be performed according to a specific given order, the axis of the magnet may be twisted, the damper ring is pushed over the wire in a predetermined position, and the assembly time is still somewhat lengthy.

SUMMARY OF THE INVENTION

It is, therefore, an object of the present invention to provide a spring reverberator having improved structures of a support member and a casing to enhance the assembling productivity and the assembling method thereof.

Another object of the present invention is to provide a spring reverberator with a pair of leads exposed outside the casing to be able to get connected to an external audio source using a common connector, thereby being capable of accommodating to distances between the spring reverberator and the external audio source.

In accordance with the present invention, there is provided a spring reverberator, a casing, a driving transducer received in the casing, a pickup transducer received in the casing, and coil springs vibratingly coupled to the driving and pickup transducers, wherein the driving and pickup transducers respectively comprise a vibration unit and a magnetic core; wherein the vibration unit comprises: a support plate including at least one cut-out groove, at least one wire with one end being soldered directly to the support plate through the cut-out groove and the other end being formed into a hook shape to make a free end of the coil spring connected thereto, a permanent magnet fixed to the wire near the hook, and a damper ring tightly fitted onto the wire between one end of the wire and the magnet; wherein the magnetic core comprises a coil-wound bobbin; and wherein the casing comprises a vibration unit seating portion, a magnetic core seating portion, and a bobbin seating portion for the vibration unit, the magnetic core, and the bobbin to mount thereon, respectively.

In an exemplary embodiment of the present invention, at least one slot for preventing heat loss is formed in the vicinity of the cut-out groove on the support plate, and a guide groove for guiding the support plate is formed at a lateral face of the vibration unit seating portion of the casing, and the support plate further comprises a protrusion corresponding to the guide groove. Further, a stop is formed at a lateral face of the vibration unit seating portion of the casing, and the support plate includes an elastic protrusion in correspondence to the stop.

In an exemplary embodiment of the present invention, the bobbin includes a pair of leads fixed to one side thereof for connection with an external sound source, and the pair of leads are electrically connected to the electric wiring in the coil.

Another aspect of the present invention provides an assembling method of a spring reverberator, comprising the steps of: preparing a pair of vibration units, each unit including a support plate comprising at least one cut-out groove, a wire with one end being soldered directly to the support plate through the cut-out groove and the other end being formed into a hook shape to make a free end of the coil spring connected thereto, and a permanent magnet fixed to the wire near the hook; providing a casing, which includes vibration unit seating portions, magnetic core seating portions, and bobbin seating portions formed respectively at both ends in a longitudinal direction thereof; pressing the support plates of the pair of the vibration units into the vibration unit seating portions of the casing; fitting coil-wound bobbins in the bobbin seating portions; and pressing magnetic cores into the magnetic core seating portions of the casing; and coupling each free end of the coil spring to the hook of the wire.

Here, the step of providing a casing is carried out before the step of preparing a pair of vibration units. In addition, the step of preparing a pair of vibration units further comprises the step of tightly fitting a damper ring onto the wire between one end of the wire and the magnet.

Meanwhile, the step of coupling each free end of the coil spring to the hook is carried out during the step of preparing a pair of vibration units.

Another aspect of the present invention provides a spring reverberator, comprising: a casing, a driving transducer received in the casing, a pickup transducer received in the casing, and coil springs vibratingly coupled to the driving and pickup transducers, wherein the driving and pickup transducers respectively comprise a vibration unit and a magnetic core; wherein the vibration unit comprises: a support plate including at least one cut-out groove and at least one slot for preventing heat loss being formed in the vicinity of the cut-out groove, at least one wire with one end being soldered directly to the support plate through the cut-out groove and the other end being formed into a hook shape to make a free end of the coil spring connected thereto, a permanent magnet fixed to the wire near the hook, and a damper ring tightly fitted onto the wire between one end of the wire and the magnet; wherein the magnetic core comprises a coil-wound bobbin; and wherein the casing comprises a vibration unit seating portion, a magnetic core seating portion, and a bobbin seating portion for the vibration unit, the magnetic core, and the bobbin to mount thereon, respectively.

In another exemplary embodiment of the present invention, the support plate comprises two cut-out grooves and the cut-out grooves are formed inwardly from the periphery of opposite lateral sides of the support plate, respectively. Further, a guide groove for guiding the support plate is formed at a lateral face of the vibration unit seating portion of the casing, and the support plate includes a protrusion corresponding to the guide groove. The bobbin includes a pair of leads fixed to one side thereof for connection with an external sound source, and the pair of leads are electrically connected to electric wiring in the coil. In addition, the pair of the leads respectively pass through holes drilled into the casing and are exposed to the exterior of the casing to be connected to an external sound source connector.

According to the spring reverberator of the present invention, the soldering process of the wire and the support plate is performed in an open space, so the soldering time is considerably shortened compared with the conventional soldering process being carried out in the narrow tubular portion with a small diameter, and this no longer requires highly skilled manual dexterity in soldering.

In addition, improperly soldered cases when a solder joint between the support plate and the wire is higher or lower than the protrusion can be easily determined as soldering defects by a simple visual inspection.

Moreover, according to the present invention, the vibration unit and the magnetic core are prepared in a modular type to be inserted in a sliding manner and fixed onto the casing. Thus, the assembly process of the spring reverberator of the present invention is relatively easier and takes shorter work time than the conventional spring reverberator assembly which utilizes separate fixing means such as screws. As a result, it is possible to significantly reduce the manufacturing costs for a spring reverberator.

The other objectives and advantages of the invention will be understood by the following description and will also be appreciated by the embodiments of the invention more clearly. Further, the objectives and advantages of the invention will readily be seen and can be realized by the means and its combination specified in the claims.

DESCRIPTION OF SPECIFIC EMBODIMENTS

Figure 1:
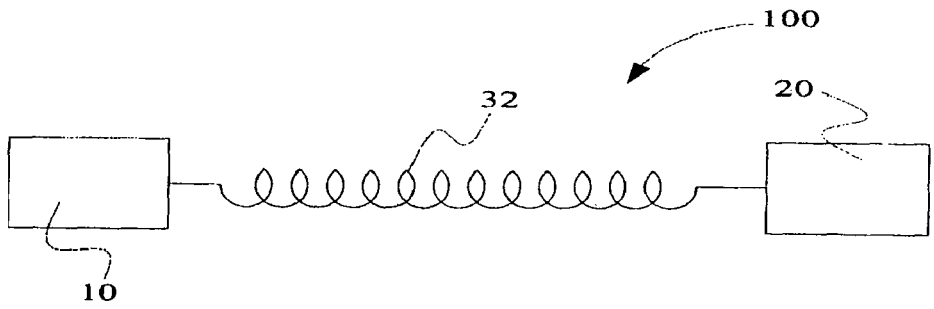
FIG. 1 is a conceptual drawing of a conventional spring reverberator.

Hereinafter, a preferred embodiment of the present invention will be set forth in detail with reference to the accompanying drawings so that those skilled in the art can easily carry out the invention. However, it is noted that the following preferred embodiment should not be interpreted as restricting the scope of the invention. In the drawings, the like parts are denoted by like numerals.

Figure 3:
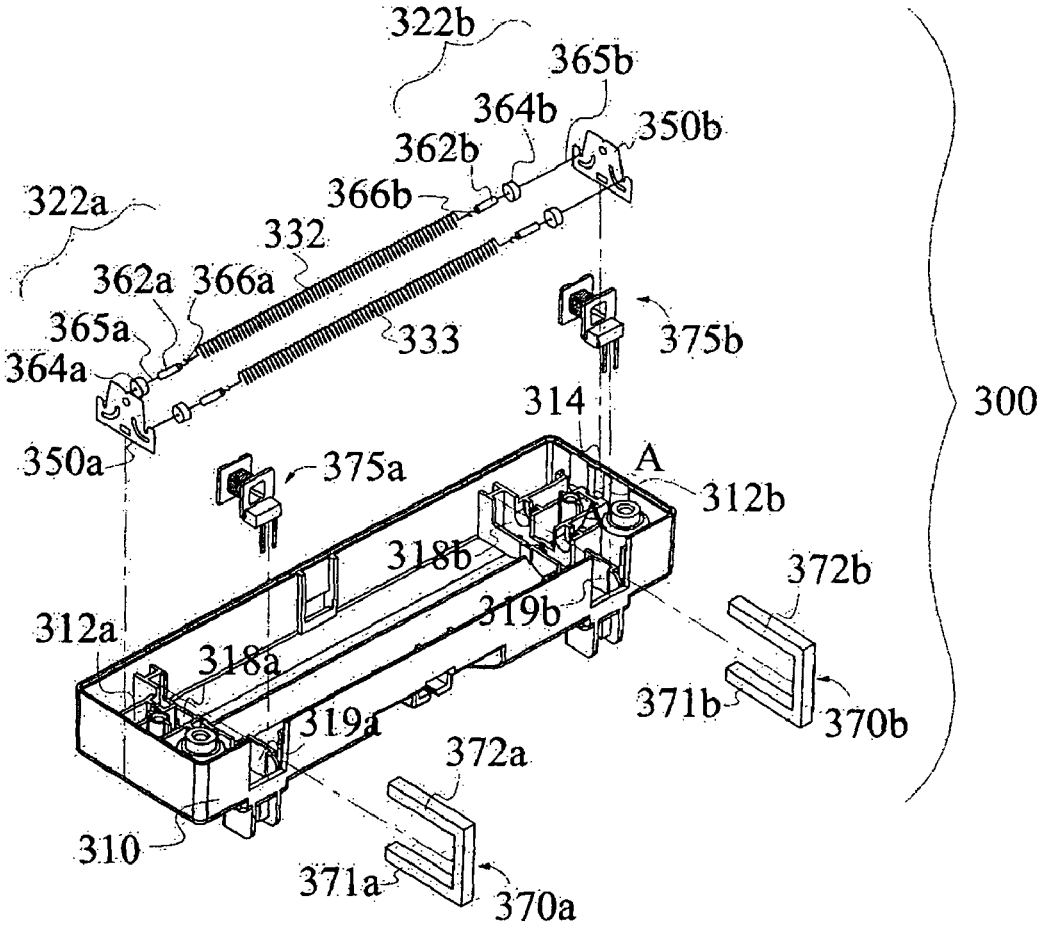
FIG. 3 is an exploded perspective view of a spring reverberator according to a preferred embodiment of the present invention.
Figure 4:
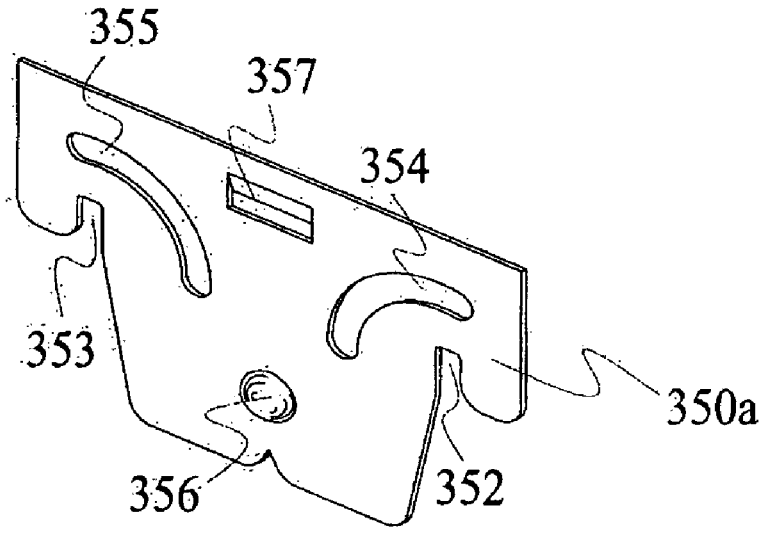
FIG. 4 is a drawing showing a support plate in FIG. 3.

FIG. 3 shows a spring reverberator according to a preferred embodiment of the present invention, and FIG. 4 shows a support plate in FIG. 3.

Referring to FIG. 3, a spring reverberator 300 includes a casing 310, a driving transducer and a pickup transducer received in the casing 310, and coil springs 332 and 333 vibrationally coupled to the driving and pickup transducers.

The driving transducer includes a vibration unit 322*a* and a magnetic core 370*a*. Similarly, the pickup transducer includes a vibration unit 322*b* and a magnetic core 370*b*. Each of the vibration units 322*a* and 322*b* of the driving and pickup transducers respectively includes support plates 350*a* and 350*b*, magnets 362*a* and 362*b* vibratingly coupled to the support plate 350*a* and 350*b* via wires 365*a* and 365*b*, and the damper rings 364*a* and 364*b* respectively. Moreover, the magnetic cores 370*a* and 370*b* include coil-wound bobbins 375*a* and 375*b*, respectively.

Referring to FIG. 3 and FIG. 4 showing the support plate, the support plates 350*a* and 350*b* are flat plates and, each one of the support plates includes cut-out grooves 352 and 353 for fixing the wires 365*a* and 365*b*, which are open outwardly at both sides. FIG. 4 illustrates two cut-out grooves 352 and 353, but the present invention is not limited thereto. The number of cut-out grooves 352 and 353 is determined depending on the number of coil springs 332 and 333 to be fixed onto the support plates 350*a*, 350*b*. Preferably, the width of the cut-out grooves 352 and 353 is slightly larger than the diameter (about 1 mm or less) of the wires 365*a* and 365*b*. In this way, when the wires 365*a* and 365*b* are inserted into the cut-out grooves 352 and 353 to be soldered and fixed to the support plates 350*a* and 350*b*, respectively, longitudinal lateral faces of the cut-out grooves 352 and 353 may guide the wires 365*a* and 365*b*. Therefore, the wires 365*a* and 365*b* can be easily inserted deeply inside the cut-out grooves 352 and 353 towards slots 354 and 355 (FIG. 4).

Figure 5:
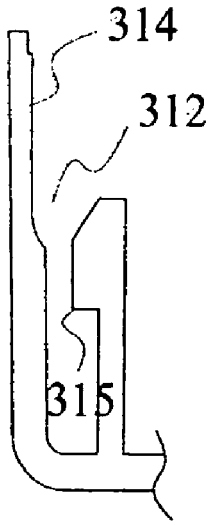
FIG. 5 is a cross sectional view taken along line A-A of FIG. 3.

As shown in FIG. 4, the support plates 350*a*, 350*b* include slots 354 and 355. When the wires 365*a* and 365*b* inserted in the cut-out grooves 352 and 253 are solder-fixed to the support plate 350*a*, the slots 354 and 355 make it possible to reduce a surface area of the support plate around the soldered portion to prevent heat loss, and also make it possible to keep the soldering from running or spreading out, to thereby make the soldering process easier. Thus, the slots 354 and 355 are preferably formed in a shape as if they embraced the insides of the cut-out grooves 352 and 353 in the vicinity of areas where the wires 365*a* and 365*b* are soldered. Also, the support plate 350*a* includes a protrusion 356 at a lower side. Meanwhile, a guide groove 314 (FIG. 5) to guide the protrusion 356 of the support plate 350*a* is formed in a lateral face of a vibration unit seating portion 312 of the casing 310 to be described below. Accordingly, when the support plates 350*a* and 350*b* are pressed down into the vibration unit seating portion 312*a* of the casing 310, the protrusion 356 of the support plate 350*a* is fitted into the guide groove 314 and guided, so that the support plates 350*a* and 350*b* are easily inserted into the casing 310 and fixed therein safely without being shaken in the width direction of the casing 310. Moreover, as the protrusion 356 is formed to have a predetermined height (this equals to the optimum height for a solder joint when the wires 365*a* and 365*b* and the support plates 350*a* and 350*b* are soldered in the cut-out grooves 352 and 353), improperly soldered cases that a solder joint between the support plate and the wire is higher or lower than the protrusion 356 can be easily determined as soldering defects by visual inspection.

Further, an elastic protrusion 357 is formed at an upper portion of the support plate 350*a*, 350*b* and is preferably formed as one piece by punching the support plate 350*a*. The elastic protrusion 357 is locked on a stop 315 (FIG. 5) of the casing 310 in order to avoid a release from the casing 310 after the support plate 350*a*, 350*b* is inserted into the vibration unit seating portion 312.

Magnets 362*a* and 362*b* are vibratingly connected to the support plates 350*a* and 350*b* via the wires 365*a* and 365*b*, respectively. To be more specific, one end of each wire 365*a*, 365*b* is soldered directly to the support plate 350*a*, 350*b* near the inner end of the cut-out groove 352, 353 respectively. The other end of each wire 365*a*, 365*b* is bent into a hooked shape 366*a*, 366*b*, to which each free end of the coil springs 332, 333 is coupled, respectively. Meanwhile, permanent magnets 362*a* and 362*b* are adhesively fixed respectively onto the wires 365*a* and 365*b* near the hooks 366*a* and 366*b* of the wires. Between one end of each wire 365*a*, 365*b* and each magnet 362*a*, 362*b*, there is a damper ring 364*a*, 364*b* being tightly fitted onto the wire 365*a*, 365*b*, respectively. The damper rings 364*a* and 364*b* serve to suppress excessive rotational vibrations of the magnets 362*a* and 362*b*.

Figure 6:
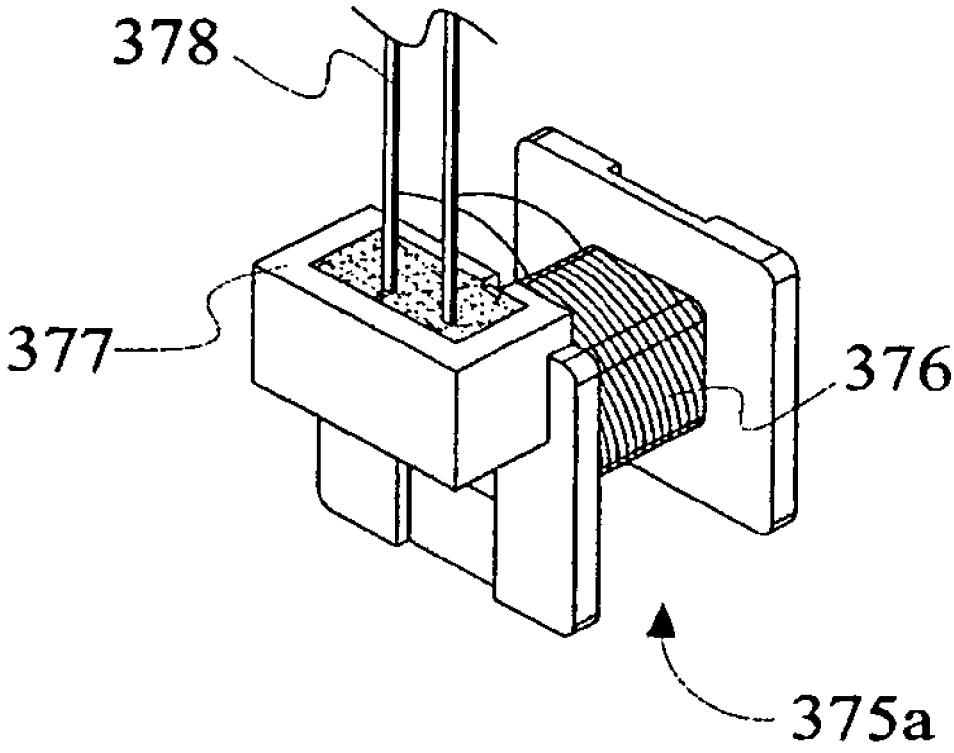
FIG. 6 shows a bobbin in FIG. 3.

Magnetic cores 370*a* and 370*b* of the driving and pickup transducers are mounted at magnetic core seating portions 318*a* and 318*b* of the casing 310, respectively. Bobbins 375*a* and 375*b* are fitted into legs 371*a* and 171*b* under the magnetic cores 370*a* and 370*b*, respectively, and coil 376 (FIG. 6) is wound around each one of the bobbins 375*a* and 375*b* to form a magnetic field. A pocket 377 (FIG. 6) is provided to a lateral face of the bobbins 375*a*, 375*b*, and a pair of leads 378 are fixed by adhesive in the pocket 377 to connect with an external sound source such as an electric musical instrument. The pair of leads 378 are electrically connected with electric wires in the coil 376, respectively. Although this is going to be explained later, bobbins 375*a* and 375*b* are seated on bobbin seating portions 319*a* and 319*b* of the casing 310, and the pair of leads 378 (FIG. 6) are inserted into the casing 310 through holes (not shown) that are formed at the bottom of the bobbin seating portions 319*a* and 319*b*. In case of a conventional reverberator, a certain length of the coil wire being wound around a bobbin is exposed to the outside, wherein the length of the wire being exposed to the outside is already determined at the time of manufacturing. Hence, a user usually finds it difficult to change the length of the wire corresponding to the distance between an external sound source and the reverberator. On the contrary, according to the reverberator of the present invention, because a signal line of an external sound source is connected to a pair of leads 378 through a connector, a user may easily correspond to the distance between the reverberator and the external sound source.

Referring again to FIG. 3, the casing 310 receives the driving transducer, the pickup transducer, and coil springs 332 and 333 vibratingly coupled between the driving transducer and the pickup transducer, wherein the transducers respectively include: a vibration unit 322*a*, 322*b* and magnetic cores 370*a* and 370*b*. The vibration unit 322*a*, 322*b* includes the support plate 350*a*, 350*b*, and magnets 362*a*, 362*b* being vibratingly connected to the support plates 350*a* and 350*b* through wires 365*a* and 365*b*, and damper rings 362*a* and 364*b*, respectively. Further, the casing 310 has vibration unit seating portions 312*a* and 312*b* and magnetic core seating portions 318*a* and 318*b* at opposite longitudinal ends thereof. As mentioned earlier, the vibration unit seating portions 312*a* and 312*b* have a guide groove 314 for the support plates 350*a* and 350*b*, respectively. The guide groove is formed at a lateral face of the casing 310, preferably at inner faces on both longitudinal ends of the casing 310. The surface of the guide groove 314 is formed in correspondence to the protrusion 356 at each of the support plates 350*a* and 350*b*. For instance, if the protrusion 356 has a convex domed shape, the surface of the protrusion has a concave domed shape corresponding to the convex domed shape. Thus, when the support plates 350*a* and 350*b* are pressed into the casing 310, the protrusion 356 formed at each one of the support plates 350*a* and 350*b* slide along the guide groove 314, so that the support plates 350*a* and 350*b* may be easily inserted in place in the casing 310. After the support plates 350*a* and 350*b* are inserted into the casing 310, the protrusion 356 engages with the guide groove 314 to thus prevent the support plates 350*a* and 350*b* from shaking in the width direction of the casing 310.

The casing 310 also includes magnetic core seating portions 318*a* and 318*b*. Each one of the magnetic core seating portions 318*a* and 318*b* has a lateral face being open in the width direction of the casing 310. As illustrated in FIG. 3, the magnetic cores 370*a* and 370*b* are inserted through these open lateral faces. The bottoms of the magnetic core seating portions 318*a* and 318*b* have roughly the same widths as the legs 371*a* and 371*b* of the magnetic cores 370*a* and 370*b*. Therefore, the magnetic cores 370*a* and 370*b* are smoothly slid into the magnetic core seating portions 318*a* and 318*b*. After the magnetic cores 370*a* and 370*b* are positioned at the magnetic core seating portions 318*a* and 318*b*, adhesive is applied to fix them to the casing 310. Meanwhile, although not shown, the casing 310 may have a cover for a dust proof effect, and this will be understood as a part of the scope of the invention by any one of ordinary skill in the art to which this invention belongs.

Referring back to FIG. 3, bobbin seating portions 319*a* and 139*b* are formed at the bottom of the casing 310 in parallel to the open lateral faces of the magnetic core seating portions 318*a* and 318*b*. Coil-wound bobbins 375*a* and 375*b* are seated on the bobbin seating portions 319*a* and 319*b* before the magnetic cores 370*a* and 370*b* are mounted on the magnetic core seating portions 318*a* and 318*b*. To this end, a pair of leads 378 (FIG. 6) are passed through holes (not shown) formed at the bottom of the bobbin seating portions 319*a* and 319*b* to expose the outside of the casing 310.

The following will now explain how to assemble the spring reverberator according to the preferred embodiment of the present invention.

Figure 2:
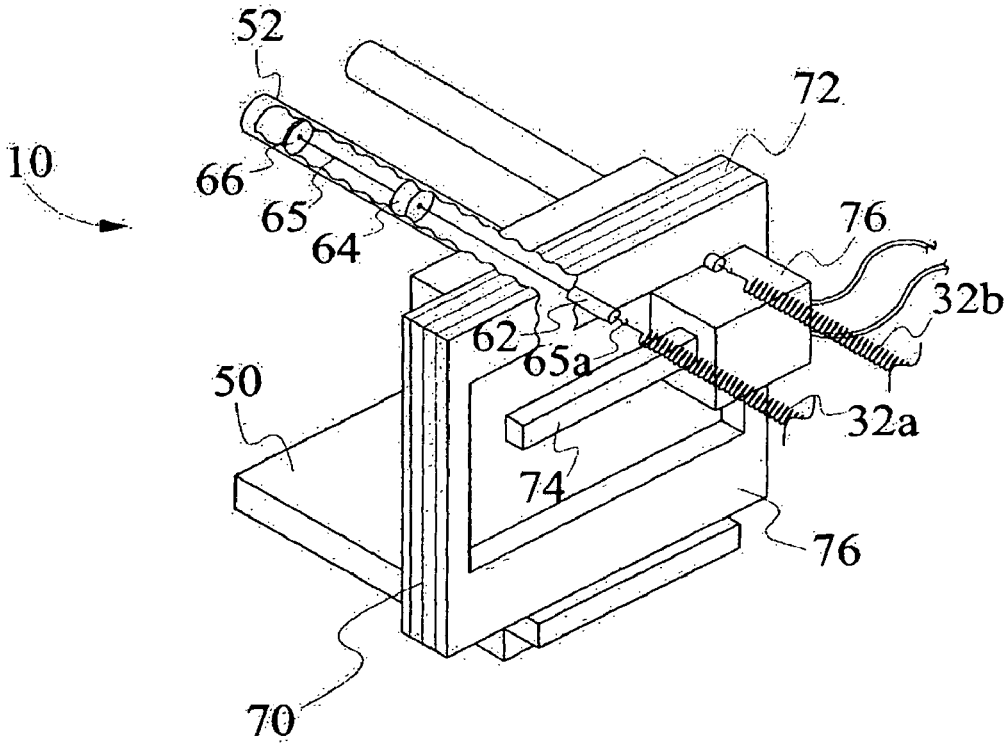
FIG. 2 is a perspective view showing a driving transducer in the conventional spring reverberator in FIG. 1.

Referring again to FIG. 3, vibration units 322*a* and 322*b* are prepared. To prepare the vibration units 322*a* and 322*b*, wires 365*a* and 365*b* are passed through annular permanent magnets 362*a* and 362*b* to dispose the magnets near the hooks 366*a* and 366*b* of the wires, and adhesive is applied to fix the magnets to the wires. Likewise, the wires 365*a* and 365*b* are passed through damper rings 364*a* and 364*b* to dispose the damper rings on predetermined positions of the wires. Next, one end of the wire 365*a*, 365*b* with the magnets 362*a*, 362*b* and damper ring 364*a*, 364*b* being fixed thereon is inserted into a cut-out groove 352, 353 and is soldered to the support plate 350*a* or 350*b* near the inner end of the cut-out groove 352, 353. According to the conventional assembly process depicted in FIG. 2, the damper ring 64 having passed through the wire 65 is pushed into the long tubular portion 52 of the support frame 50. Then, the washer ring 66 is inserted onto the wire 65 from the opposite end of the tubular portion 52, and the washer 66 and the wire 65 are fixed together by soldering. Therefore, highly skilled manual dexterity in soldering and a considerable amount of time are required in assembling the conventional reverberator since the soldering process is carried out in the narrow tubular portion 52 having a small diameter. On the other hand, according to the present invention, the support frame with a long tubular portion in the conventional reverberator is now replaced by flat, metal support plates 350*a* and 350*b*, each having cut-out grooves 352 and 353, and wires 365*a* and 365*b* are directly soldered to the support plates 350*a* and 350*b* near the inner end of the cut-out grooves 352 or 353 with permanent magnets 362*a* and 362*b* fixed adhesively onto the wires 365*a* and 365*b*. As such, the soldering process in the present invention is performed in an open space, so the soldering time is considerably shortened compared with the conventional soldering process being carried out in the narrow tubular portion 52 having a small diameter, and highly skilled manual dexterity in soldering is not required. Moreover, as mentioned earlier, improperly soldered cases where a solder joint between the support plate and the wire is higher or lower than the protrusion 356 can be easily determined as soldering defects by a simple visual inspection.

And, the support plates 350*a* and 350*b* are pressed into the vibration unit seating portions 312*a* and 312*b* of the casing 310. As explained before, the protrusions 356 of the support plates 350*a* and 350*b* are guided by the guide grooves 314 of the casing 310 to allow the support plates 350*a* and 350*b* be easily inserted into the casing 310. After the support plates 350*a* and 350*b* are inserted into the casing 310, the protrusions 356 engages with the guide grooves 314 to prevent the support plates 350*a* and 350*b* from shaking in the width direction of the casing 310. As such, according to the present invention, the vibration units 322*a* and 322*b* may be immobilized simply by pressing the support plates 350*a* and 350*b* into the casing 310. When the support plates 350*a* and 350*b* are inserted into the vibration unit seating portions 312*a* and 312*b*, the elastic protrusions 357 (FIG. 4) of the support plates 350*a* and 350*b* are held tightly by the stop 315 (FIG. 5) that are formed at lateral faces of the vibration unit seating portions 312*a* and 312*b*. This can avoid the release of the support plates 350*a* and 350*b* from the vibration unit seating portions 312*a* and 312*b*, respectively.

Next, coil-wound bobbins 375*a* and 375*b* are inserted into the bobbin seating portions 319*a* and 319*b* of the casing 310. At this time, a pair of leads 378 (FIG. 6) are passed through holes (not shown) formed at the bottoms of the bobbin seating portions 319*a* and 319*b* to expose outside the casing 310, so that they may be connected electrically to an external connector (not shown).

Later, magnetic cores 370*a* and 370*b* are pressed into the casing 310 through the open lateral faces of the magnetic core seating portions 318*a* and 318*b*. The bottoms of the magnetic core seating portions 318*a* and 318*b* are slightly wider than the legs 371*a* and 371*b* of the magnetic cores 370*a* and 370*b*, so as to allow the magnetic cores 370*a* and 370*b* to slide into the magnetic core seating portions 318*a* and 318*b*, respectively. Meanwhile, the height of the bobbins 375*a* and 375*b* is preset such that when the magnetic cores 370*a* and 370*b* slidably fit into the seating portions 318*a* and 318*b*, their legs 371*a* and 371*b* pass through the bobbins 375*a* and 375*b*, i.e., making the bobbins 375*a* and 375*b* fitted into the legs 371*a* and 371*b*, respectively. After the magnetic cores 370*a* and 370*b* are inserted into the seating portions 318*a* and 318*b*, adhesive for example is applied to fix them to the casing 310. Preferably, the magnetic cores 370*a* and 370*b* are formed into a "⊂" shape, to avoid interference with the wires 365*a* and 365*b* especially when they are inserted into the seating portions 318*a* and 318*b*.

Lastly, following the insertion of the vibration units 322*a* and 322*b* and the magnetic cores 370*a* and 370*b* into the casing 310, free ends of the coil springs 332 and 333 are coupled to hooks 366*a* and 366*b* of the wires to complete the assembly process of the spring reverberator of the present invention. Alternatively, the coil springs 332 and 333 may be coupled to the hooks 366*a* and 366*b* before the assembled vibration units 322*a* and 322*b* are inserted into the casing 310.

While the present invention has been described with respect to the specific embodiments, it will be apparent to those skilled in the art that various changes and modifications may be made without departing from the spirit and scope of the invention as defined in the following claims.

What is claimed is:

1. A spring reverberator, comprising:

a casing, a driving transducer received in the casing, a pickup transducer received in the casing, and coil springs vibrationally coupled to the driving and pickup transducers, wherein the driving and pickup transducers respectively comprise a vibration unit and a magnetic core;

wherein each vibration unit comprises:

a support plate including at least one cut-out groove, at least one wire with one end being soldered directly to the support plate through the cut-out groove and the other end being formed into a hook shape to make a free end of the coil spring connected thereto, a permanent magnet fixed to the wire near the hook, and a damper ring tightly fitted onto the wire between one end of the wire and the magnet;

wherein the magnetic core comprises a coil-wound bobbin; and wherein the casing comprises a vibration unit seating portion, a magnetic core seating portion, and a bobbin seating portion for the vibration unit, the magnetic core, and the bobbin to, mount thereon, respectively.

2. The spring reverberator according to claim 1, wherein at least one slot for preventing heat loss is formed in the vicinity of the cut-out groove on the support plate.

3. The spring reverberator according to claim 1, wherein a guide groove for guiding the support plate is formed at a lateral face of the vibration unit seating portion of the casing, and the support plate further comprises a protrusion corresponding to the guide groove.

4. The spring reverberator according to claim 3, wherein a stop is formed at a lateral face of the vibration unit seating portion of the casing, and the support plate includes an elastic protrusion in correspondence to the stop.

5. The spring reverberator according to claim 1, wherein the bobbin includes a pair of leads fixed to one side thereof for connection with an external sound source, and the pair of leads are electrically connected to electric wiring in the coil.

6. An assembling method of a spring reverberator, comprising the steps of:

preparing a pair of vibration units, each unit including a support plate including at least one cut-out groove, a wire with one end being soldered directly to the support plate through the cut-out groove and the other end being formed into a hook shape to make a free end of the coil spring connected thereto, and a permanent magnet fixed to the wire near the hook;

providing a casing, which includes vibration unit seating portions, magnetic core seating portions, and bobbin seating portions formed respectively at both ends in a longitudinal direction thereof;

pressing the support plates of the pair of the vibration units into the vibration unit seating portions of the casing;

fitting coil-wound bobbins in the bobbin seating portions;

pressing magnetic cores into the magnetic core seating portions of the casing; and coupling each free end of the coil spring to the hook of the wire.

7. The method according to claim 6, wherein the step of providing a casing is carried out before the step of preparing a pair of vibration units.

8. The method according im claim 6, wherein the step of preparing a pair of vibration units further comprises the step of:

tightly fitting a damper ring onto the wire between one end of the wire and the magnet.

9. The method according to claim 8, wherein the step of coupling each free end of the coil spring to the hook is carried out during the step of preparing a pair of vibration units.

* * * * *